United States Patent [19]

Sable

[11] Patent Number: 4,787,448

[45] Date of Patent: Nov. 29, 1988

[54] ROD GUIDE

[76] Inventor: Donald E. Sable, 14175 Proton Rd., Dallas, Tex. 75244

[21] Appl. No.: 86,555

[22] Filed: Aug. 18, 1987

[51] Int. Cl.[4] ..... E21B 37/02

[52] U.S. Cl. ..... 166/176; 166/241

[58] Field of Search ..... 166/175, 176, 241

[56] References Cited

U.S. PATENT DOCUMENTS

| | | | |
|---|---|---|---|
| 3,364,998 | 1/1968 | Sable | 166/176 X |
| 3,442,558 | 5/1969 | Sable | 166/241 X |
| 3,507,525 | 4/1970 | Sable | 403/404 X |
| 4,088,185 | 5/1978 | Carson | 166/241 X |

FOREIGN PATENT DOCUMENTS

| | | | |
|---|---|---|---|
| 903669 | 6/1972 | Canada | 166/176 |

*Primary Examiner*—Stephen J. Novosad
*Assistant Examiner*—William P. Neuder

[57] ABSTRACT

A rod guide assembly for rods of a sucker rod string having a pair of longitudinally spaced stops rigidly secured to the sucker rod and a plurality of independently movable guide body sections mounted on the rod between these stops for limited longitudinal movement between these stops.

6 Claims, 1 Drawing Sheet

ROD GUIDE

This invention relates to well tools and more particularly to rod guides for sucker rods of a rod guide string employed to actuate a pump connected in the tubing of the well.

BACKGROUND OF THE INVENTION

Well fluids are pumped from a well fluid producing earth formation through a tubing string which extends to the surface by a pump connected to the bottom end of the tubing string. The pump is actuated by a sucker rod string which is reciprocally moved in the tubing by a drive means located at the surface, the sucker rod string alternately being moved upwardly by the drive means and then allowed to move downwardly by its own weight. In some cases sinker bars may be connected to the lower portions of sucker rod string to minimize flexing of the sucker rod string due to the downward pressure of the weight of the upper portions of the sucker rod string on the lower portions. This flexing of some portions of the sucker rod string would cause the rods of the string to contact the internal surfaces of the tubing. Moreover, the tubing itself is not perfectly straight. In fact, it is somewhat helical or corkscrew in form so that the sucker rods, even if the sucker rod string itself were straight, would also contact the tubing at various locations along the length of the tubing. Such sliding contact of the rods with the tubing would of course cause damage both to the sucker rods and the tubing.

In order to prevent such contact of the sucker rods with the tubing, the rods are conventionally provided with guides or centralizers which are rigidly secured to the rods at several longitudinally spaced locations along each rod.

Some of such guides are of the type shown in the U.S. Pat. No. 3,442,558 to D. F. Sable, which are formed of a resilient substance and which resiliently grip the rod so that relatively great longitudinal forces must be exerted thereon to move the guide relative to the rod.

Other rod guides are molded on the rods and are formed of such substances as are disclosed in U.S. Pat. No. 4,088,185 to F. J. Carson.

Many such molded in place guides are formed of a plastic available commercially under the trademark Ryton.

The rigid molded in place rod guides require that a much greater force to be exerted thereon before they are displaced on the rod than the above described guides which resiliently grip the rod. The rigid rod guides, however, are subject to chipping.

Whether provided with rod guides of either of the above described types of rod guides, a large proportion of the guides are always in contact with the internal surfaces of the tubing. As a result, upon reversal of downward movement of the sucker rod string to upward movement, the force required to move the sucker rod string upwardly not only must overcome the weight of the sucker rod string and its inertia plus the force needed to force upward movement of the column of fluids in the tubing, but also the frictional resistance between the rod guides and the internal surfaces of the tubing string. Obviously the great upward forces exerted on the sucker rod string upon each such reversal of downward to upward movement of the rod string shorten the life of the sucker rods. Upon reversal of upward to downward movement of the sucker rod string, the forces exerted by upper portions of the rod string on the lower portions are greatly increased where the lower portions of the rod string have rod guides rigid therewith. To decrease such flexing forces in such cases requires the use of sinker bars of considerable weight. This, of course, increases the force which must be exerted on the sucker rod string to move it upwardly.

Since such rod guides which are rigidly mounted will wear and abrade at the locations of their sliding contact with the tubing, the guides will abrade or wear at such locations of their periphery. To provide even wear along the entire periphery of the rod guides, the sucker rod string must be rotated through some angle during each cycle of reciprocatory movement thereof.

OBJECTS OF THE INVENTION

Accordingly, it is an object of this invention to provide a rod guide which does not resist longitudinal movement of the rod on which it is mounted at the initiation of reversal of movement of the rod even though the guide is in frictional contact with a tubing string through which the rod extends.

Another object is to provide a rod guide assembly having a guide body which is slidably mounted on the rod to permit limited longitudinal movement of the rod relative to rod guide mounted thereon.

Still another object is to provide a rod guide assembly, of the type described, having longitudinally spaced stops clamped to the rod between which the guide body is mounted.

Another important object of the invention is to provide a rod guide which is free to rotate on the rod guide on which it is mounted.

Still another object is to provide a rod guide assembly, of the type described, wherein the guide body is provided with external ribs which extend angularly relative to its central longitudinal axis whereby the forces exerted thereon by well fluids flowing through the passages formed by the ribs tend to rotate the guide body.

Another important object is to provide a rod guide, of the type described, whose body has two or more sections to permit relative freedom of movement of the sections as when one section is in contact with the well tubing and the other is not.

BRIEF DESCRIPTION OF THE INVENTION

The rod guide has a pair of stops each of which has a metal clip or clamp which clamps or compressively forces a plastic liner against a sucker rod and a guide body slidably mounted on the rod between the stops. The guide body may be formed of one or more independently movable sections. The stops are spaced to permit limited longitudinal movement of the rod relative to the guide body, for example, one half inch to one and one half inches where the guide body is six and a half inches in length.

DESCRIPTION OF THE DRAWINGS

Additional objects and advantages of the invention will be readily apparent from the reading of the following descriptions of a device constructed in accordance with the invention and reference to the accompanying drawings thereof, wherein.

Figure 1:
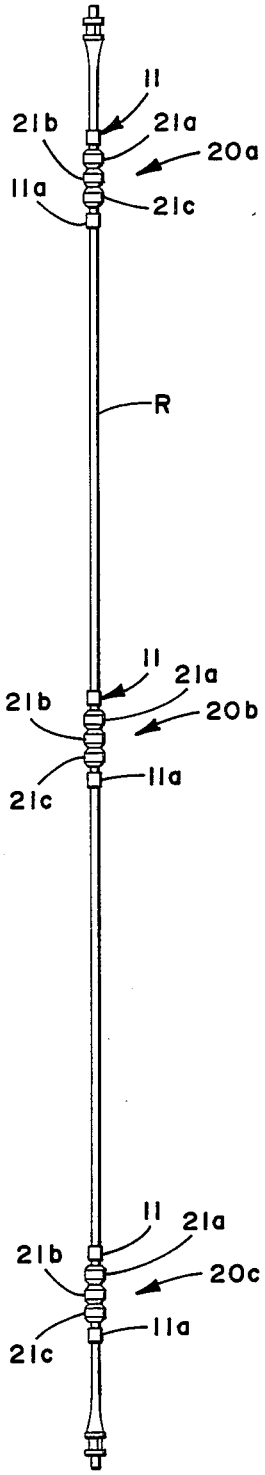
FIG. 1 is a plan view of a sucker rod provided with rod guide assemblies embodying the invention.
Figure 3:
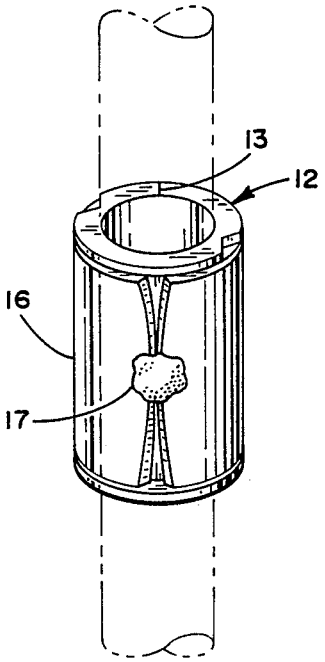
FIG. 3 is a perspective view of a stop of the rod guide.
Figure 2:
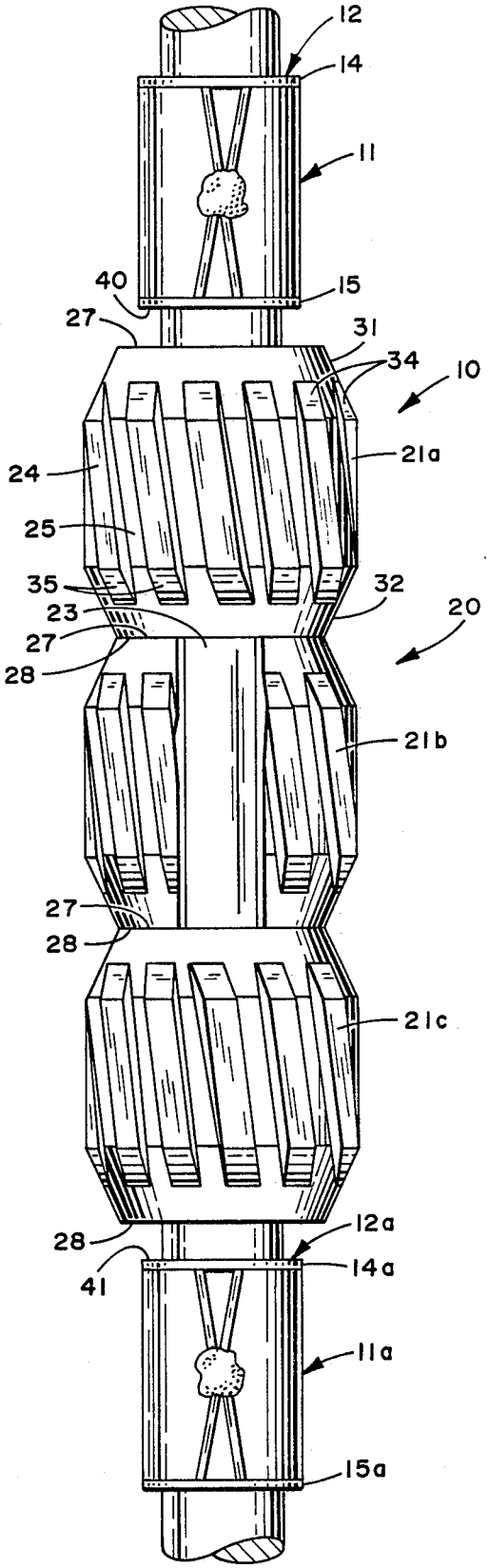
FIG. 2 is a plan view of the rod guide.

Referring now to the drawings, the rod guide assembly 10 embodying the invention includes a pair of stops 11 and 11*a* of the type described in the U.S. Pat. No. 3,507,525 to D. E. Sable. Each stop includes a liner 12 formed of a plastic, such as is commercially available under the trade name Nylon, which when exposed to well fluids absorbs such fluids and tends to swell.

The liner is slit, as at 13, and is provided with external flanges 14 and 15 at its opposite ends. A metal clip 16 located between the flanges is bent about the liner compressing it against the rod. Its adjacent ends are welded as at 17.

The stop 11*a* being identical to the stop 11, its elements have been provided with the same reference numerals, to which the subscript a has been added, as the corresponding elements of the stop 11. The guide body 20 is slidably mounted on the rod R between the stops 11 and 11*a* and is formed of three identical sections 21*a*, 21*b* and 21*c*. The sections may be of the same form and construction as the scrapers described and illustrated in the U.S. Pat. No. 3,364,998 to D. E. Sable.

Each of the guide body sections has a central bore of slightly greater diameter than the diameter of the sucker rod on which it is mounted and has a longitudinal slot 23 which extends at an angle relative to the central longitudinal axis of the section. The section is made of a somewhat resilient substance, such as is available under the tradename Nylon. The slot 23 is smaller in width than the diameter of the rod so that as the section is forced onto the rod through the slot 23, the opposite portions of the sections are flexed apart to permit movement of the section onto the rod. The sections are provided with external spaced ribs 24 which extend longitudinally at an angle to the central longitudinal axis of the section. The ribs define passages or channels 25 through which well fluids may flow.

Each section has planar top and bottom end surfaces 27 and 28, respectively, and top and bottom inwardly convergent beveled top and bottom surfaces 31 and 32. The ribs also have beveled top and bottom surfaces 34 and 35. The bevelled surfaces of the sections help cam or slide the sections past internal obstructions in the tubing and along the internal surfaces of the well tubing at locations where the tubing is not straight.

In use, each sucker rod is provided with a plurality of the rod guide assemblies. For example, as shown in FIG. 1, the rod R which is twenty-five feet long is provided with three rod guide assemblies. The top and bottom assemblies 20*a* and 20*c* are spaced three feet from the top and bottom ends, respectively, of the rod and the middle rod guide assembly is located at the middle of the rod, that is, twelve and a half feet from either end of the rod.

The stops 11 and 11*a* of each rod guide assembly are spaced apart a distance somewhat greater than the length of the guide body 20 mounted therebetween on the rod. For example, if the guide body is formed of three sections each being two inches in length, the distance between the bottom end 40 of the upper stop 11 and the top end 41 of the lower stop may be between six and a half inches to seven and a half inches.

In use, the sucker rod string is made up of a plurality of rods R and, depending on the depth at which the well fluid producing earth formation is located, may be several thousand feet long.

At the beginning of a downward movement or stroke of the sucker rod string, as the sucker rod string is allowed to move downwardly, it moves by gravity downwardly but the guides 20 tend to remain stationary being held against downward movement by the upward force exerted thereon by well fluids flowing upwardly therepast. Any of the sections which are not in contact with the tubing will be rotated by the forces exerted thereon by the well fluids flowing through the inclined passages 25 in a counterclockwise direction as seen from above. The sections in contact with the internal surface of the tubing will also tend to rotate in this direction by the frictional force exerted thereon due to the angular inclination of the ribs relative to the longitudinal axis of the guide body.

It will be apparent that upon initiation of a downward stroke of the sucker rod string, the guide bodies on the rods offer no or very little resistance to the downward movement of the sucker rod string even if one or more sections of each guide body are in frictional contact with internal surfaces of the well tubing since at the beginning of the downward stroke, the guide bodies are resting on the top end surfaces 41 of the stops 11*a*.

Each rod must move one half inch or more, depending on the distance between the end surfaces 40 and 41 of each rod guide assembly, before the weight of the rod string must overcome any frictional resistance between a guide body section and the well tubing. During this initial downward movement of the sucker rod string, the resistance to its downward movement is therefore minimal.

As the bottom surface 40 of each rod guide assembly engages the top surface 27 of its guide body 20, the rod string has already gained downward momentum which will help overcome any frictional resistance between a rod guide body and the internal surfaces of the well tubing.

At the bottom end of a downward stroke of the sucker rod string, all rod guide bodies are in their topmost positions held against further upward movement by the top stops 11.

Upon reversal from downward movement to upward movement of the sucker rod string, the rod guide bodies again do not impede initial upward movement of the rods on which they are mounted until the rods have moved upwardly a half inch or more, and the lower stop surfaces 41 engage the bottom surfaces 28 of the lowermost sections of the guide bodies.

By this time the inertia of the tubing string has been overcome so that the peak upward force which must be exerted on the sucker rod string is greatly smaller as compared to a sucker rod string having rod guides which are rigid with the rod so that not only the inertia of the rod string but also the frictional resistance between the guides and the well tubing must be simultaneously overcome at the time of reversal from downward to upward movement of the sucker rod string.

It will now be seen that a new and improved rod guide assembly has been illustrated and described which greatly decreases the stresses and strains to which a sucker rod string is subjected during its reciprocation in a well tubing.

It will also be seen that the provision of guide bodies which are slidably and rotatably mounted on a rod for limited longitudinal movement thereon provide for uniform wear of the guide bodies.

The foregoing description of the invention is explanatory only and changes in the details of the construction illustrated may be made by those skilled in the art, within the scope of the appended claims, without departing from the invention.

What is claimed and desired to be secured by Letters Patent is:

1. A rod guide assembly for a sucker rod longitudinally reciprocably movable in a well flow conductor comprising: a pair of longitudinally spaced upper and lower stops rigidly secured to a sucker rod; and a guide body movably mounted on said rod between said stops, said stops being spaced from each other a distance slightly greater than the length of said guide body, said upper stop engaging said guide body to move said guide body downwardly with said rod after an initial short downward movement of said rod after initiation of each downward movement of the rod and said lower stop engaging said guide body to move said second guide body upwardly with said rod after initial short upward movement of said rod after initiation of each upward movement of the rod during the longitudinal reciprocatory movement of said rod in a well flow conductor.

2. The rod guide assembly of claim 1, wherein said guide body is provided with longitudinal outwardly extending ribs, said ribs being disposed at an angle to the central longitudinal axis of the rod whereby said guide body is rotatable on the rod by the forces exerted on said ribs by well fluids flowing therepast.

3. The rod guide of claim 2 wherein said stop means comprises a resilient liner and a clamp compressing said liner about the rod.

4. The rod guide assembly of claim 3, wherein said guide body comprises a plurality of longitudinal sections independently movable on the rod.

5. The rod guide assembly of claim 1, wherein said guide body comprises a plurality of longitudinal sections independently movable on the rod.

6. The rod guide assembly of claim 2, wherein said guide body comprises a plurality of longitudinal sections independently movable on the rod.

* * * * *